US008493300B2

(12) United States Patent
Santo et al.

(10) Patent No.: US 8,493,300 B2
(45) Date of Patent: Jul. 23, 2013

(54) ARCHITECTURE AND TECHNIQUE FOR INTER-CHIP COMMUNICATION

(75) Inventors: Hendrik Santo, San Jose, CA (US); Ranajit Ghoman, Santa Clara, CA (US); Dilip Sangam, Saratoga, CA (US); Kien Vi, San Jose, CA (US)

(73) Assignee: Atmel Corporation, San Jose, CA (US)

( * ) Notice: Subject to any disclaimer, the term of this patent is extended or adjusted under 35 U.S.C. 154(b) by 1352 days.

(21) Appl. No.: 12/046,280

(22) Filed: Mar. 11, 2008

(65) Prior Publication Data

US 2009/0230882 A1 Sep. 17, 2009

(51) Int. Cl.
*G09G 3/36* (2006.01)

(52) U.S. Cl.
USPC ..... 345/87; 345/102

(58) Field of Classification Search
USPC ..... 345/87, 102, 204, 212; 349/61, 69
See application file for complete search history.

(56) References Cited

U.S. PATENT DOCUMENTS

| | | | | |
|---|---|---|---|---|
| 5,315,214 | A | 5/1994 | Lesea | |
| 5,722,040 | A | 2/1998 | Bjerede et al. | |
| 5,744,986 | A | 4/1998 | Yamada et al. | |
| 6,172,556 | B1 | 1/2001 | Prentice | |
| 6,593,709 | B2 | 7/2003 | Lee et al. | 315/302 |
| 6,633,138 | B2 | 10/2003 | Shannon et al. | 315/224 |
| 7,151,520 | B2 * | 12/2006 | Maki | 345/99 |
| 7,339,471 | B1 | 3/2008 | Chan et al. | |
| 7,583,035 | B2 | 9/2009 | Shteynberg et al. | |
| 8,044,919 | B2 * | 10/2011 | Song et al. | 345/102 |
| 8,072,444 | B2 * | 12/2011 | Ikeda et al. | 345/204 |
| 8,144,106 | B2 * | 3/2012 | Kim | 345/102 |
| 2002/0145041 | A1 | 10/2002 | Muthu et al. | |
| 2004/0105264 | A1 | 6/2004 | Spero | |
| 2005/0184708 | A1 | 8/2005 | Pipen et al. | |

(Continued)

FOREIGN PATENT DOCUMENTS

| | | |
|---|---|---|
| CN | 201114961 | 9/2008 |
| JP | 2160283 A | 6/1990 |

(Continued)

OTHER PUBLICATIONS

International Search Report and Written Opinion for PCT Application No. PCT/US2009/053777 dated Nov. 5, 2009, 11 pages.

(Continued)

*Primary Examiner* — Abbas Abdulselam
(74) *Attorney, Agent, or Firm* — Fish & Richardson P.C.

(57) ABSTRACT

The present invention involves an electrical system in which an analog signal channel passes through various integrated circuit chips (ICs). The channel can carry one or more analog signals. Each IC can modify the signal(s) passing through it and pass it on to another IC or system component. The channel can be programmable. Each IC can include a comparator or a multiplexor to receive the channel signal from another IC or system component and to modify the received signal before transmitting it to another IC or system component. The comparator or the multiplexor can be programmable and can be selectively configured to compare the incoming signal from the channel with a variety of other signals and thresholds, or to simply act as a flow through gate and allow the signal to pass without any modification. The comparison can determine the output of the comparator. The operation and programming of the comparators, the multiplexors and the channel can be centrally controlled by a system controller, can be independently controlled by the ICs, or a combination thereof.

7 Claims, 3 Drawing Sheets

U.S. PATENT DOCUMENTS

| | | | |
|---|---|---|---|
| 2006/0022214 | A1 | 2/2006 | Morgan et al. |
| 2006/0033536 | A1 | 2/2006 | Thelen et al. |
| 2006/0214603 | A1 | 9/2006 | Oh et al. |
| 2007/0040512 | A1 | 2/2007 | Jungwirth et al. |
| 2007/0075958 | A1 | 4/2007 | Kim et al. |
| 2007/0091067 | A1 | 4/2007 | Elsheimer et al. |
| 2007/0139319 | A1 | 6/2007 | Nishida et al. |
| 2007/0273299 | A1 | 11/2007 | Miskin et al. |
| 2007/0285133 | A1 | 12/2007 | Dickman et al. |
| 2008/0042045 | A1 | 2/2008 | Miyazawa |
| 2008/0084222 | A1 | 4/2008 | Yen |
| 2008/0170012 | A1 | 7/2008 | S et al. |
| 2008/0191631 | A1 | 8/2008 | Archenhold et al. |
| 2008/0224629 | A1 | 9/2008 | Melanson |
| 2008/0278097 | A1 | 11/2008 | Roberts et al. |
| 2008/0309611 | A1 | 12/2008 | Yang |
| 2009/0079362 | A1 | 3/2009 | Shteynberg et al. |
| 2009/0128045 | A1 | 5/2009 | Szczeszynski et al. |
| 2009/0179589 | A1 | 7/2009 | Buhler et al. |
| 2009/0184904 | A1 | 7/2009 | S. et al. |
| 2009/0224736 | A1 | 9/2009 | Santo et al. |
| 2009/0231247 | A1 | 9/2009 | Dhayagude et al. |
| 2009/0267652 | A1 | 10/2009 | Santo et al. |
| 2009/0315467 | A1 | 12/2009 | Schindler et al. |
| 2010/0013395 | A1 | 1/2010 | Archibald et al. |
| 2010/0188443 | A1 | 7/2010 | Lewis et al. |
| 2010/0237786 | A1 | 9/2010 | Santo et al. |

FOREIGN PATENT DOCUMENTS

| | | | |
|---|---|---|---|
| JP | 2003131620 | | 5/2003 |
| JP | 2003288045 | | 10/2003 |
| JP | 2004271759 | A | 9/2004 |
| JP | 2006185942 | | 7/2006 |
| JP | 2007013530 | A | 1/2007 |
| WO | WO2009016588 | A1 | 2/2009 |

OTHER PUBLICATIONS

International Search Report and Written Opinion for PCT Application No. PCT/US2009/048505 dated Jul. 31, 2009, 10 pages.

International Search Report and Written Opinion for PCT Application No. PCT/US2009/048769 dated Jan. 1, 2009, 10 pages.

JP Office Action; Sep. 18, 2012; Japan; 2010-550742; 5 pages.

International Search Report and Written Opinion for PCT Application No. PCT/US2009/035334 dated Apr. 28, 2009, 10 pages.

International Preliminary Report on Patentability; BAI; Jul. 12, 2012; World Intellectual Property Organization (WIPO) (International Bureau of); 7 pages.

International Search Report and Written Opinion; Pitard /Henderson; Jul. 6, 2011; World Intellectual Property Organization (WIPO) (International Bureau of); PCT/US2010/061011; 10 pages.

* cited by examiner

ARCHITECTURE AND TECHNIQUE FOR INTER-CHIP COMMUNICATION

FIELD OF INVENTION

The present invention relates to apparatus and techniques for communications between integrated circuit chips (ICs).

BACKGROUND OF THE INVENTION

Electronic systems can include multiple ICs. Communications between those ICs can be conducted directly or indirectly. Direct communication can involve two ICs directly exchanging information. Indirect communication can involve two ICs indirectly exchanging information by way of a controller IC. mSilica Inc., the assignee of the present invention designs and develops electrical systems in which inter-chip communication is performed. For example, mSilica Inc. is the assignee of U.S. patent application Ser. No. 11/942,239 entitled "Apparatus and Technique for Modular Electronics Display Control," which discloses a novel modular approach for backlight control of a liquid crystal display. According to that approach, several driver ICs share the workload of the system controller and are used to control the LED strings of the backlighting system. Each driver IC controls a portion of the strings. The U.S. patent application Ser. No. 11/942,239 is incorporated herein by reference in its entirety. In such systems, real time communication among the ICs is desirable. The present invention provides novel architecture and techniques for inter-chip communications that are efficient, easy to implement, and can be done in real time.

SUMMARY OF THE INVENTION

The present invention involves an electrical system in which an analog signal channel passes through various integrated circuit chips (ICs). The channel can carry one or more analog signals. Each IC can modify the signal(s) passing through it and pass it on to another IC or system component. The channel can be programmable. Each IC can include a comparator or a multiplexor to receive the channel signal from another IC or system component and to modify the received signal before transmitting it to another IC or system component. The comparator or the multiplexor can be programmable and can be selectively configured to compare the incoming signal from the channel with a variety of other signals and thresholds, or to simply act as a flow through gate and allow the signal to pass without any modification. The comparison can determine the output of the comparator. The operation and programming of the comparators, the multiplexors and the channel can be centrally controlled by a system controller, can be independently controlled by the ICs, or a combination thereof.

BRIEF DESCRIPTION OF THE DRAWINGS

The above and other objects and advantages of the present invention will be apparent upon consideration of the following detailed description, taken in conjunction with the accompanying drawings, in which like reference characters refer to like parts throughout, and in which.

DETAILED DESCRIPTION OF THE INVENTION

Figure 1:
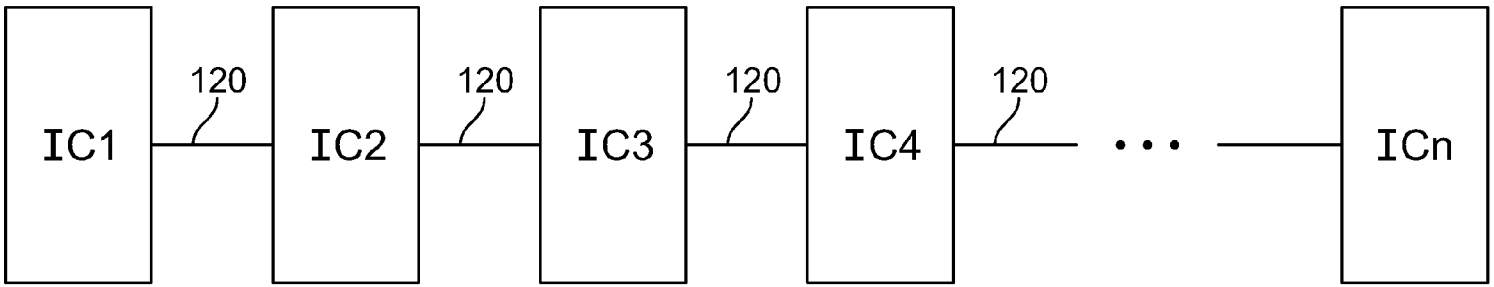
FIG. 1 illustrates an exemplary functional block diagram of the system of the present invention.

FIG. 1 illustrates an exemplary architecture of the system of the present invention. FIG. 1 shows a number of ICs 1, 2, 3, 4 and n arranged in a daisy chain fashion and coupled together by a signal channel 120. The signal channel 120 can include a wire, an electrical conductor, a trace, or the like that can be used to conduct inter-chip analog signal transmission among the ICs 1-*n*. The signal channel 120 can include a stream of information that can be transmitted among the various ICs 1-*n*, wherein the information can be adjusted by the various ICs 1-*n*.

Figure 2:
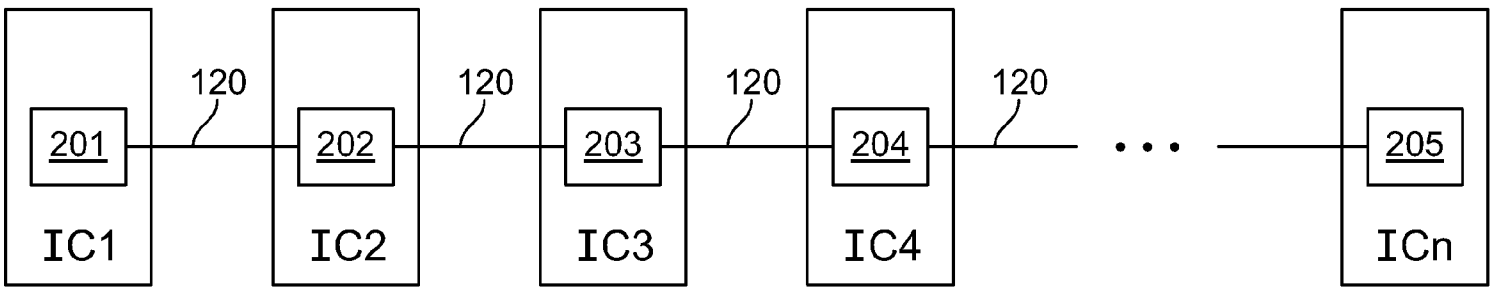
FIG. 2 illustrates another exemplary functional block diagram of the system of the present invention.

FIG. 2 illustrates another exemplary architecture of the system of the present invention. In FIG. 2, the signal channel 120 passes through signal adjustment blocks 201, 202, 203, 204 and 205 inside the ICs 1-*n* respectively. In one embodiment, the signal adjustment blocks 201-205 can adjust the level of the analog signal flowing through the signal channel 120. In one embodiment, the signal adjustment blocks 201-205 can compare the analog signal received from the signal channel 120 with another signal and can adjust the level of the analog signal based on the comparison. In one embodiment, the signal adjustment blocks 201-205 can compare the analog signal received from the signal channel 120 with a threshold voltage or current value and can adjust the level of the analog signal based on the comparison. One of ordinary skill in the art will appreciate that analog signals can be compared by comparing the instantaneous values, the average values, the root mean square (values), or the like, of the analog signals.

In one embodiment, the signal adjustment blocks 201-205 can compare the analog signal received from the signal channel 120 with multiple signals and adjust the level of the analog signal based on the comparison. In one embodiment, the signal adjustment blocks 201-205 can be programmable. The signal adjustment blocks 201-205 can be implemented in hardware, software or firmware. In one embodiment, the signal adjustment blocks 201-205 can include multiplexors. In one embodiment, the signal adjustment blocks 201-205 include operational amplifiers. In one embodiment, the signal adjustment blocks 201-205 include comparators. In one embodiment, some or all the signal adjustment blocks 201-205 can have the same or similar structure and functionality.

Figure 3:
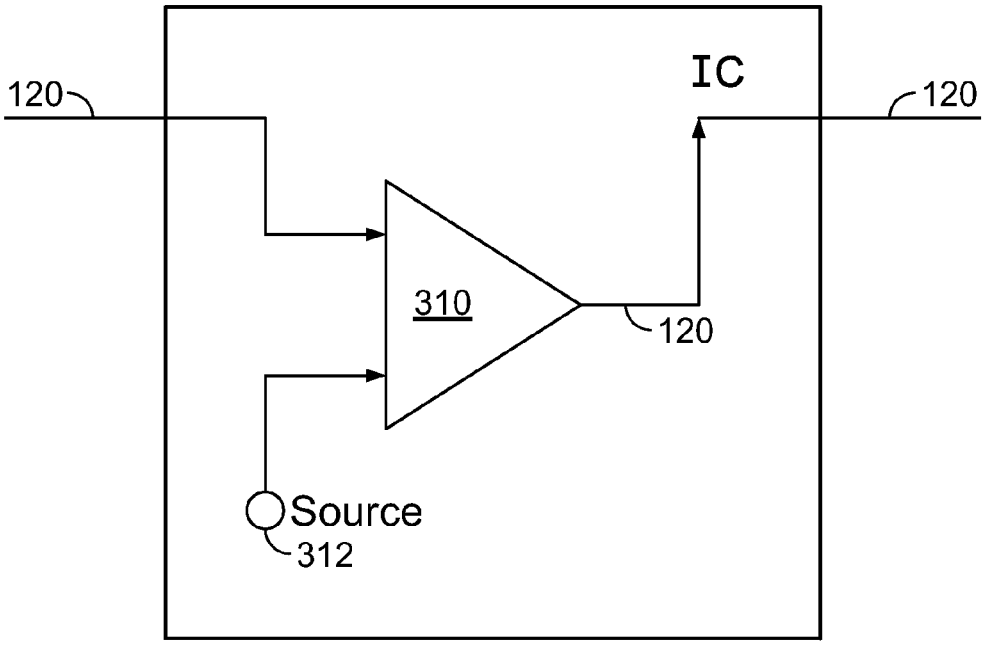
FIG. 3 illustrates an exemplary functional block diagram of the integrated circuit chip (IC) of the present invention.

FIG. 3 illustrates a functional block diagram for the IC of the present invention, which can represent any or all of the ICs 1-*n*. In this example, the adjustment block includes a two-input comparator 310. One input of the comparator 310 is coupled to the signal channel 120. The other input of the comparator 310 is coupled is coupled to another signal source 312. The comparator 310 compares the signal provided by the signal channel 120 and the signal provided by the signal source 312. The result of the comparison can be used to adjust the level of the signal transmitted by the signal channel 120. In one embodiment, the level of signal transmitted by the signal channel 120 can be adjusted to the level of the higher of the two inputs of the comparator 310. In one embodiment, the level of the signal transmitted by the signal channel 120 can be adjusted to the level of the lower of the two inputs of the comparator 310.

One of ordinary skill in the art will understand that the comparator 310 can include more than two inputs and that the level of the signal transmitted by the signal channel 120 can be adjusted based on the result of the comparison of those inputs. One of ordinary skill in the art will understand that the comparator 310 can be a programmable device and can be programmed to output a signal that is based on the comparison and that the level of the output signal can be different from the level of either of the input signals of the comparator 310. In one embodiment, the comparator 310 can be selectively programmed to not perform the comparison and act as a flow through gate to pass on the signal on the signal channel 120 without any adjustment.

In one embodiment, the comparator 310 can be replaced with a multiplexor. The multiplexor can multiplex its inputs including the signal on the signal channel 120 and transmit them to another chip or system component. In one embodiment, all the signals multiplexed by the multiplexors of all the ICs 1-*n* are received by a destination IC or a system component. The destination IC or system component can then analyze all the signals and, for example, determine the signal having the lowest signal level and/or the lowest signal level of the multiplexed signals.

Figure 4:
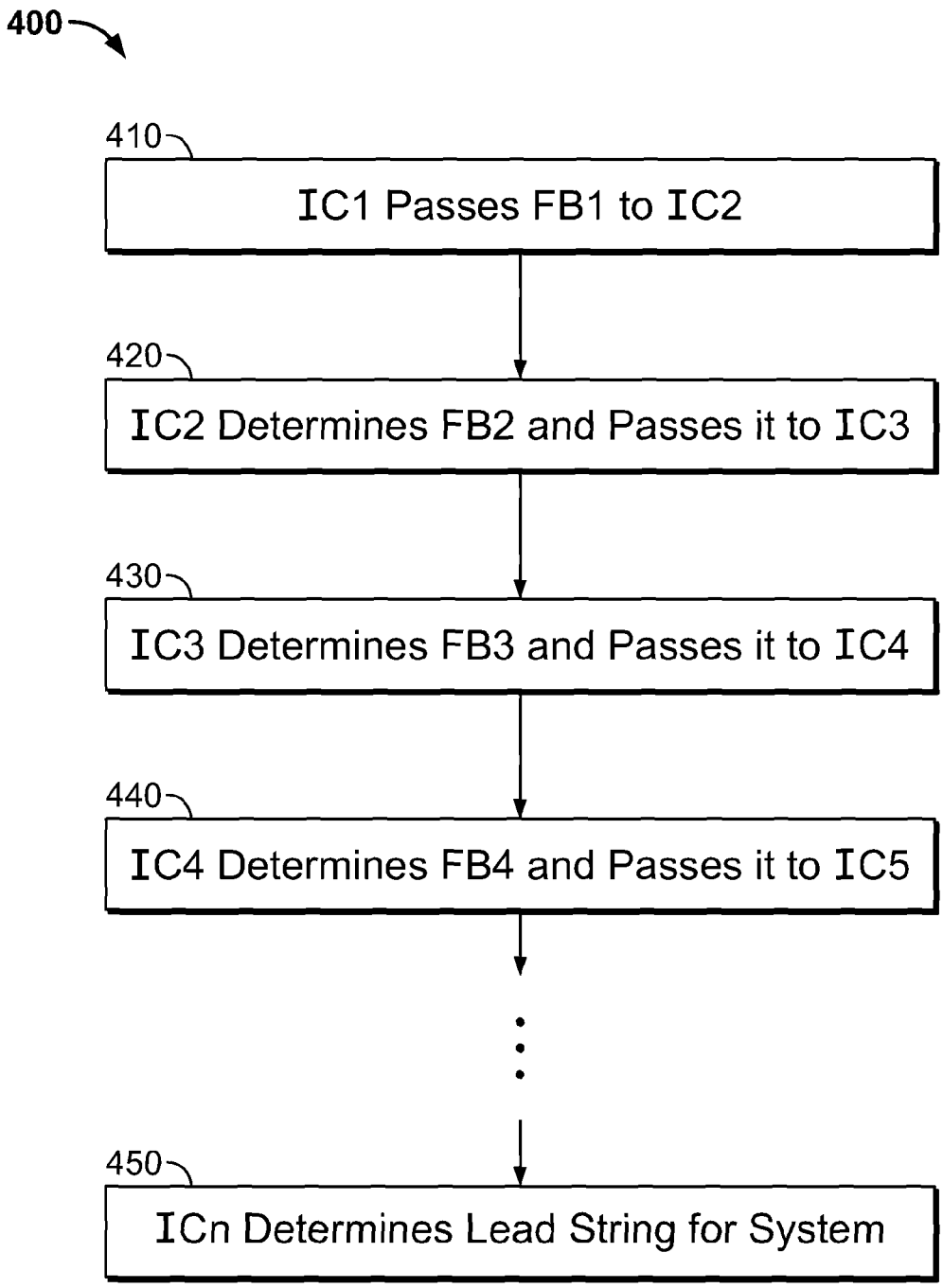
FIG. 4 illustrates an exemplary flow chart for an application of the present invention.

FIG. 4 illustrates a flow chart 400 for an exemplary application of the electrical system of the present invention. In this application, the ICs 1-*n* are used for driving strings of LEDs for a backlighting system of a LCD. Each IC 1-*n* drives a different set of LED strings. Each set can include, for example, six LED strings. Each IC 1-*n* can receive feedback signals indicative of the current flowing through each of the LED strings that it controls. At block 410, IC1 compares the six feedback signals related to the six LED strings that it drives and transmits the feedback signal having the lowest level of the six signals (FB1) to IC2. At block 420, IC2 compares FB1 with the lowest of the six feedback signals that it receives from its six strings, and passes the signal having the lower level of those two signals (FB2) to IC3. At block 430, IC3 compares FB2 with the lowest of the six feedback signals that it receives from its six strings, and passes the signal having the lower level of those two signals (FB3) to IC4. At block 440, IC4 compares FB3 with the lowest of the six feedback signals that it receives from its six strings, and passes the signal having the lower level of those two signals (FB4) to IC5 (not shown). At block 450, the last IC in the chain ICn makes the final comparison between the signal received from its preceding IC in the chain (IC (n−1)) and the lowest of the six feedback signals that it receives from its six strings. The lowest LED string drive current for the system is thus determined.

The present invention provides a unique and elegant technique in which an analog channel interconnects multiple chips. A comparison can be progressively made between analog output signals of sequential chips of the daisy chain and either the higher or the lower of the two signals selected for comparison with the output of the next chip in the daisy chain. In this manner, the ultimate highest or the lowest of all output signals generated by all the chips in the daisy chain is determined. One of ordinary skill in the art will appreciate that the techniques, structures and methods of the present invention discussed above are exemplary. The present invention can be implemented in various embodiments without deviating from the scope of the invention.

The invention claimed is:

1. A liquid crystal display comprising:

a backlighting circuitry comprising:

a first plurality of integrated circuit chips, wherein each of the first plurality of integrated circuit chips comprises a comparison circuit comprising an output, and wherein each comparison circuit is configured to compare an analog signal with another signal to produce an output signal at the output;

an electrical channel for transmitting the analog signal; and a second plurality of integrated circuit chips, each of which is also coupled to the electrical channel;

wherein the electrical channel is coupled to each of the first plurality of integrated circuit chips;

each of the first plurality of integrated circuit chips can modify the analog signal based on the output signal of the comparison circuit of the integrated circuit chip; and each of the first plurality of integrated circuit chips can drive a plurality of strings of light emitting diodes.

2. The liquid crystal display of claim 1, wherein the output signal of the comparison circuit includes the signal having a higher current of the analog signal and the another signal being compared.

3. The liquid crystal display of claim 1, wherein at least one comparison circuit is configured to compare the current of the analog signal and the current of the another signal, wherein the another signal is an electric signal propagated through at least one string of light emitting diodes.

4. The liquid crystal display of claim 1, wherein at least one comparison circuit is configured to receive, as an input signal for comparison, the another signal representing the voltage flowing through at least one string of light emitting diodes.

5. A liquid crystal display comprising:

a backlighting circuitry comprising:

a plurality of integrated circuit chips, wherein each of the plurality of integrated circuit chips comprises a comparison circuit comprising an output, and wherein each comparison circuit is configured to compare an analog signal with another signal to produce an output signal at the output; and an electrical channel for transmitting the analog signal;

wherein the electrical channel is coupled to each of the plurality of integrated circuit chips;

each of the plurality of integrated circuit chips can modify the analog signal based on the output signal of the comparison circuit of the integrated circuit chip;

each of the plurality of integrated circuit chips can drive a plurality of strings of light emitting diodes; and the comparison circuits in each of the plurality of integrated circuit chips are configured compare the analog signal with the respective another signal, wherein the another signal has a threshold voltage value, to generate the output signal, the output signal having the lower voltage of the analog signal and the another signal being compared.

6. A liquid crystal display comprising:

a backlighting circuitry comprising:

a plurality of integrated circuit chips, wherein each of the plurality of integrated circuit chips comprises a comparison circuit comprising an output, and wherein each comparison circuit is configured to compare an analog signal with another signal to produce an output signal at the output; and an electrical channel for transmitting the analog signal;

wherein the electrical channel is coupled to each of the plurality of integrated circuit chips;

each of the plurality of integrated circuit chips can modify the analog signal based on the output signal of the comparison circuit of the integrated circuit chip;

each of the plurality of integrated circuit chips can drive a plurality of strings of light emitting diodes;

in each of the plurality of integrated circuit chips, the respective another signal is configured to be an electric signal propagated through at least one of the strings of light emitting diodes that the respective integrated circuit chip can drive; and in each of the plurality of integrated circuit chips, the comparators are configured to generate the output signal to comprise either the analog signal or the another signal based on which of the analog signal and the another signal has a higher current; and each of the plurality of integrated circuit chips is configured to modify the current of the analog signal to match the higher current such that the analog signal in a last chip of the plurality of integrated circuit chips has a highest current of the analog signal and all of the another signals from the of the strings of light emitting diodes among all of the plurality of integrated circuit chips.

7. A liquid crystal display comprising:

a backlighting circuitry comprising:

a plurality of integrated circuit chips, wherein each of the plurality of integrated circuit chips comprises a comparison circuit comprising an output, and wherein each comparison circuit is configured to compare an analog signal with another signal to produce an output signal at the output; and an electrical channel for transmitting the analog signal; wherein the electrical channel is coupled to each of the plurality of integrated circuit chips;

each of the plurality of integrated circuit chips can modify the analog signal based on the output signal of the comparison circuit of the integrated circuit chip;

each of the plurality of integrated circuit chips can drive a plurality of strings of light emitting diodes; and in each of the plurality of integrated circuit chips, the another signal is an electric signal propagated through at least one of the strings of light emitting diodes that the chip can drive;

in each of the plurality of integrated circuit chips, the comparators are configured to generate the output signal to have a lower voltage of the analog signal and the another signal being compared; and each of the plurality of integrated circuit chips modifies the analog signal to have the lower voltage such that the analog signal in a last chip of the plurality of integrated circuit chips has a lowest voltage of the analog signal and all of the another signals from the of the strings of light emitting diodes among all of the plurality of integrated circuit chips.

* * * * *

UNITED STATES PATENT AND TRADEMARK OFFICE

CERTIFICATE OF CORRECTION

PATENT NO. : 8,493,300 B2
APPLICATION NO. : 12/046280
DATED : July 23, 2013
INVENTOR(S) : Hendrik Santo It is certified that error appears in the above-identified patent and that said Letters Patent is hereby corrected as shown below:

In the Claims

In Column 4 Line 43, Claim 5, after "configured" insert --to--.

In Column 5 Line 14, Claim 6, after "from the" delete "of the".

In Column 6 Line 21, Claim 7, after "from the" delete "of the".

Signed and Sealed this
First Day of October, 2013

Teresa Stanek Rea

Teresa Stanek Rea
*Deputy Director of the United States Patent and Trademark Office*